US009179783B2

(12) United States Patent
Snell et al.

(10) Patent No.: US 9,179,783 B2
(45) Date of Patent: Nov. 10, 2015

(54) BED BUG PROTECTION DEVICE

(75) Inventors: Eric Snell, Meansville, GA (US); Carrie Snell, Meansville, GA (US)

(73) Assignee: Snell R&D, LLC, Meansville, GA (US)

( * ) Notice: Subject to any disclaimer, the term of this patent is extended or adjusted under 35 U.S.C. 154(b) by 0 days.

(21) Appl. No.: 13/305,030

(22) Filed: Nov. 28, 2011

(65) Prior Publication Data

US 2012/0137433 A1 Jun. 7, 2012

Related U.S. Application Data

(60) Provisional application No. 61/420,114, filed on Dec. 6, 2010.

(51) Int. Cl.

| | |
|---|---|
| ***A47G 9/02*** | (2006.01) |
| ***A47C 31/00*** | (2006.01) |
| *A47G 9/00* | (2006.01) |

(52) U.S. Cl.

CPC ..... *A47C 31/007* (2013.01); *A47G 9/0246* (2013.01); *A47G 2009/001* (2013.01)

(58) Field of Classification Search

CPC ..... A47C 21/00; A47G 9/02
USPC ..... 5/496–497, 499, 493, 53.1
See application file for complete search history.

(56) References Cited

U.S. PATENT DOCUMENTS

| | | | | |
|---|---|---|---|---|
| 168,306 A | | 9/1875 | Watkins | |
| 391,930 A | | 10/1888 | Wilson | |
| 1,464,397 A | | 8/1923 | Royak | |
| 1,856,931 A | | 5/1932 | Scott | |
| 3,761,973 A | * | 10/1973 | Leventhal | 5/484 |
| 4,304,018 A | * | 12/1981 | McClam | 5/494 |
| 5,233,710 A | * | 8/1993 | Bernard | 5/424 |
| 5,392,559 A | | 2/1995 | Long | |
| 5,636,393 A | | 6/1997 | Zafiroglu et al. | |
| 5,638,562 A | * | 6/1997 | Masoncup | 5/493 |
| 5,910,081 A | | 6/1999 | Graham | |

(Continued)

FOREIGN PATENT DOCUMENTS

| | | |
|---|---|---|
| CN | 201070177 | 6/2008 |
| CN | 101247719 | 8/2008 |

(Continued)

OTHER PUBLICATIONS

International Search Report dated Mar. 26, 2012, relating to PCT/US2011/062281.

(Continued)

*Primary Examiner* — Fredrick Conley
(74) *Attorney, Agent, or Firm* — Kim Winston LLP

(57) ABSTRACT

A bed bug protection device for protecting humans, animals and objects from crawling pests such as bed bugs. The device includes a top component for contacting the top surface of bedding such as a mattress or box spring. The top component includes barrier material suitable for preventing pests from biting humans or animals resting on the bedding. The device further includes a fitted side skirt joined to the periphery of the top component that hinders bed bugs and similar pests from climbing up the covered bedding and gaining access to humans, animals, or objects resting atop the bedding. The device may be part of a system including pillow protectors, headboard and/or footboard protectors for preventing contact by traditional bed coverings with walls or bed structures that may be infested by bed bugs.

22 Claims, 7 Drawing Sheets

(56) References Cited

U.S. PATENT DOCUMENTS

| | | | | |
|---|---|---|---|---|
| 5,966,759 | A | 10/1999 | Sanders et al. | |
| 6,017,601 | A | 1/2000 | Amsel | |
| 6,037,281 | A | 3/2000 | Mathis et al. | |
| 6,223,463 | B1 | 5/2001 | Carlson | |
| 6,463,606 | B2 | 10/2002 | Barker et al. | |
| 6,499,157 | B1 | 12/2002 | McCain et al. | |
| 6,779,311 | B2 | 8/2004 | Roberts | |
| 6,823,544 | B2 | 11/2004 | Treece | |
| 6,842,921 | B1 * | 1/2005 | Tsiarkezos et al. | 5/497 |
| 6,887,807 | B1 | 5/2005 | Matsushita et al. | |
| 6,942,748 | B2 | 9/2005 | Cree et al. | |
| 6,964,074 | B2 | 11/2005 | Carlitz | |
| 6,987,075 | B2 | 1/2006 | Orlandi | |
| 7,051,388 | B1 * | 5/2006 | Taddeo | 5/498 |
| 7,062,808 | B1 | 6/2006 | Brogden | |
| 7,290,381 | B2 | 11/2007 | Smith et al. | |
| 7,392,555 | B2 | 7/2008 | Danaher | |
| 7,552,489 | B2 | 6/2009 | Bell et al. | |
| 7,591,099 | B2 | 9/2009 | Lang et al. | |
| 7,625,829 | B1 | 12/2009 | Cree et al. | |
| 7,655,583 | B2 | 2/2010 | Marche | |
| 7,674,733 | B2 | 3/2010 | Wu et al. | |
| 7,802,330 | B2 | 9/2010 | Tillery | |
| 7,802,334 | B1 | 9/2010 | Larios | |
| 7,938,435 | B2 | 5/2011 | Sousa et al. | |
| 7,951,732 | B2 | 5/2011 | Dharmarajan et al. | |
| 2001/0041248 | A1 | 11/2001 | Matsushita et al. | |
| 2002/0148047 | A1 | 10/2002 | Corzani et al. | |
| 2004/0139552 | A1 | 7/2004 | Walters, Jr. | |
| 2005/0019364 | A1 | 1/2005 | Frandsen et al. | |
| 2006/0160453 | A1 | 7/2006 | Suh | |
| 2007/0107662 | A1 | 5/2007 | Queen et al. | |
| 2008/0005845 | A1 | 1/2008 | Pfleger | |
| 2008/0028522 | A1 | 2/2008 | Atwood | |
| 2008/0032581 | A1 | 2/2008 | Avery et al. | |
| 2008/0305134 | A1 | 12/2008 | Lucas | |
| 2009/0094755 | A1 | 4/2009 | Murphy et al. | |
| 2009/0154844 | A1 | 6/2009 | Greenberg | |
| 2009/0271926 | A1 * | 11/2009 | Bell et al. | 5/499 |
| 2010/0009587 | A1 | 1/2010 | Tillery | |
| 2010/0139002 | A1 | 6/2010 | Walker et al. | |
| 2010/0281614 | A1 | 11/2010 | Park | |
| 2010/0308194 | A1 | 12/2010 | Pal, Jr. | |
| 2011/0009024 | A1 | 1/2011 | Clark | |
| 2011/0033673 | A1 | 2/2011 | Kawka | |
| 2011/0039468 | A1 | 2/2011 | Baldwin, Jr. et al. | |
| 2011/0047860 | A1 | 3/2011 | Black et al. | |
| 2011/0067182 | A1 | 3/2011 | Kussoff | |
| 2011/0250419 | A1 | 10/2011 | Muslet et al. | |
| 2011/0311603 | A1 | 12/2011 | Lucas | |
| 2012/0096759 | A1 | 4/2012 | Biggs | |
| 2012/0117728 | A1 | 5/2012 | O'Neill | |
| 2012/0167302 | A1 | 7/2012 | Malouf et al. | |

FOREIGN PATENT DOCUMENTS

| | | | |
|---|---|---|---|
| EP | 0323116 | A1 | 7/1989 |
| FR | 2800255 | A1 | 5/2001 |
| GB | 2329834 | | 4/1999 |
| RU | 2048097 | | 11/1995 |
| WO | 2007011914 | A2 | 1/2007 |

OTHER PUBLICATIONS

Bed Bugs, Integrated Pest Management in and Around the Home, Pest Notes, Publication 7454, May 2009, four pages.

Bed Bug Handbook: The Complete Guide to Bed Bugs and Their Control, Chapter 10/Insecticides, three pages.

Zoecon Professional Products, BedBug Central, Bed Bugs 101—Early Detection Tools & Methods, copyright 2007-2011, four pages.

ClimbUp Monitor for Bed Bugs / Insect Interceptor, copyright 2008-2012, one page.

* cited by examiner

BED BUG PROTECTION DEVICE

CROSS REFERENCE TO RELATED APPLICATION

This application claims the benefit of U.S. Provisional Application No. 61/420,114, filed Dec. 6, 2010, the disclosure of which is incorporated herein in its entirety.

FIELD OF THE INVENTION

The present invention relates in general to pest control and in particular to apparatus for controlling bed bugs and related pests.

BACKGROUND OF THE INVENTION

Bed bug infestations are increasing at an alarming rate throughout the world. However, existing chemical control methods such as fumigation and the like are not keeping pace due to the growing resistance of bed bugs to insecticides. Similarly, thermal or heat treatment is commonly used as a means to combat bed bugs, but such treatment also has its disadvantages. For instance, apart from the obvious danger of using high energy heaters in enclosed spaces, it has been observed that some bed bugs successfully flee the heat-treated area only to return later. Consequently, because of the limitations of current pesticidal and thermal treatment methods, it is difficult to completely kill or remove all bed bugs that infest a room.

The bed frame, mattress, box spring, and headboard are some of the most heavily infested areas of a typical bedroom. Since presently available control methods are unlikely to completely eliminate all living bed bugs, sedentary and sleeping persons will continue to provide blood meals to the bed bug population whereby the infestation cycle continues.

Other measures have been proposed, if not as ways of eliminating bed bugs, but as barriers between the bugs and their mammalian (human or pet) hosts.

Included among these are U.S. Patent Application Publication Nos. 2005/0019364 and 2008/0305134 which respectively disclose the concepts of treating a pillow cover and a bedding cover with pesticidal substances. Since a portion of the population may be particularly sensitive to such chemicals, items so treated may not represent a viable solution to the problem of bed bug or other insect infestation of bedding.

Others, including U.S. Pat. Nos. 7,552,489 and 7,802,334, as well as U.S. Patent Application Publication No. 2010/0281614, have proposed encasements for entirely enveloping mattresses and box springs. A primary disadvantage of such encasements is that they are difficult to place around a mattress or a box spring. That is, mattresses and box springs are large, unwieldy objects that are not readily insertable into pocket-like encasements. A user must raise the entirety of the mattress or box spring from the surface on which it rests in order to properly install the encasement. This is no mean feat for persons of limited strength. Moreover, these devices are intended to prevent escape of pests from the encased mattress or box spring. None address the problem of bed bugs that may scale the sides of the encased mattress or box spring and reach the upper surface where they might bite persons or pets resting thereon. Similarly, U.S. Patent Application Publication No. 2009/0154844 describes a portable, zippered bag for protecting luggage, clothing and similar travel-related items from pests such as bed bugs. The bag is described as being fabricated from smooth, non-porous, plastic material that offers little or no bug harborages. The bag is not disclosed as being useful for protecting mattresses, box springs or the like. However, even if were scaled to such size, it would be very difficult for many users to insert a mattress or box spring therein.

U.S. Patent Application Publication No. 2011/0067182 describes a bed bug proof mattress. Even if its claims to bed bug resistance are true, an investment in a new mattress is expensive and not a viable option for persons of limited resources. Additionally, a bed is not portable. While such a bed may be useful for its intended purpose at the site at which it is located, it is of little use to travelers who cannot transport the bed with them. Further, once such a bed is covered with linens, it, like any other bed, is subject to bed bugs scaling the sidewalls of the bed and accessing humans, animals or other objects resting atop the bed.

U.S. Patent Application Publication Nos. 2007/0107662; 2008/0032581 and 2010/0009587 disclose multilayer bed linens that are intended to protect persons from contact with bed bugs. These coverings include an impervious barrier layer over which lies a fibrous fabric layer that contacts the user's body. The barrier layer functions to prevent bed bugs from accessing the user while the fabric layer is provided for comfort. The difficulty with these bed coverings arises from the presence of the fabric layer covering the barrier layer. Such fabric surfaces enable bed bugs to gain traction sufficient to scale the sides of the bed that the linens are intended to protect and expose users lying on the bed to bed bug bites.

Bed wetting covers/mattress protectors are also known. These protectors are typically fabricated from flexible liquid resistant plastic materials such as vinyl or the like. However, once a conventional fabric, e.g. linen, bedding sheet is placed over such a cover there is no protection from bed bugs. That is, contact between the tucked fabric sheet and the underlying structure, e.g., a box spring, enables bed bugs to climb the sheet and access persons and animals lying atop the bed.

It is also long-known to cover furniture with clear vinyl slipcovers that visually expose the underlying furniture yet protect the furniture from perspiration and other stains. Such slipcovers are individually tailored and assembled to cover to the furniture they are intended to protect (such as chairs and sofas). Popular in the mid-twentieth century, they have since fallen into disfavor. Custom-fit clear vinyl furniture coverings are marketed by Home Design Shop, Inc. of Southampton, Pa.

It is not believed that clear vinyl furniture slipcovers were ever used to cover bedding. Possible reasons include:

1. Unlike other furniture such as chairs and sofas, bedding structures such as mattresses and box springs are essentially utilitarian, not decorative, and are not intended for public display in both their in-use (sleeping) and non-use states. They are covered by sheets blankets, and the like, which themselves provide comfort and decorative functionality. Hence, there is no point in covering bedding with protective material that reveals its visual appearance.

2. If used as bedding covering, clear vinyl would be uncomfortable against a user's skin because it would not "breathe" and wick perspiration from the skin.

Of additional significance, clear vinyl furniture slipcovers are not intended to be covered by or effectively retain additional covering material such as bedding linens or the like since such material would mask the underlying furniture and thereby defeat an essential purpose of the clear slipcovers. Further, vinyl slipcovers typically include zippers and vents that could enable bed bugs to pass from the interior to the exterior of the slipcovers.

Flexible plastic outdoor furniture and equipment (e.g., grill) covers are also known. However, such covers are not designed for nor would they be suitable for covering bedding. Not surprisingly, they do not have moisture wickable material on their upper surface. Indeed, the presence of such material would defeat the dedicated purpose of the covers. That is, liquid permeable material would permit moisture to penetrate the cover and cause harm to the underlying furniture or equipment.

In addition, many outdoor covers include vents. Thus, even if one were somehow inspired to use an outdoor cover as a bed covering, and assuming such a cover could somehow sensibly accommodate a bed, the presence of a vent would enable bed bugs or similar pests to pass from the interior to the exterior of the cover and access the linens or other conventional bed coverings placed over the device. Upon accessing the conventional bed coverings the pests may climb them to reach the top surface of the bed and bite humans or animals lying on the bed.

Further, it is also known to provide, essentially, an object enclosure or "tent" affixed atop a bed covering in order to bar encroachment by bed bugs and the like. Such devices are marketed by Anteater Pest Control, Inc. of Duluth, Ga. For claustrophobic persons, or persons that require unrestricted freedom of movement while sleeping, such devices do not constitute a viable pest control option.

An advantage exists, therefore, for an non-restrictive, fitted protective bedding cover that is easily placed onto and removed from bedding such as mattresses, box springs, and the like. The cover should permit ready receipt of conventional fabric bedding sheets yet provide an impassible barrier between crawling pests such as bed bugs and humans, animals and objects resting on the bedding.

SUMMARY OF THE INVENTION

The present invention provides an easily installable and removable device for covering bedding, which device protects humans, animals and objects from crawling pests such as bed bugs. The device includes a top component which is adapted to contact the top surface of bedding such as a mattress or box spring. The top component comprises barrier material suitable for preventing passage of the needle-like mouthparts of bed bugs whereby bed bugs cannot penetrate the material and bite humans or animals resting on the bedding. The top component may comprise either a porous material including at least one layer having pores smaller than the needle-like mouthparts of bed bugs or an essentially non-porous material alone or in combination with an overlying porous material for contacting a user's skin. The device further includes a fitted side skirt joined to the periphery of the top component and having a slippery, i.e., low friction, exterior surface that hinders bed bugs and similar pests from climbing up the covered bedding and gaining access to humans, animals, or objects resting atop the bedding.

According to a first embodiment, the skirt is preferably of sufficient length whereby it may be tucked into the interface between the bottom of a mattress and the top of a box spring yet still drape at least partially over the side walls of the box spring. So constructed, conventional bed coverings such as linens, blankets, comforters and the like may be inserted or tucked into the fold or tuck established by the skirt while remaining isolated from crawling pests by virtue of the expanse of skirt material inserted between the bed and box spring and draped over the sides of the box spring.

According to further embodiments, the skirt is also of sufficient length to cover a mattress and at least an upper region of the sidewalls of a box spring. Pursuant to these embodiments, supplemental means may be provided to insure that linens and other conventional bed coverings do not contact the box spring below the lower edge of the low-friction skirt.

According to a further embodiment, a top sheet is secured to the cover. In this embodiment, the length of the skirt is preferably long enough to drape at least partially over the sidewalls of the box spring.

The invention also encompasses additional features. Among these are pillow, headboard and footboard barriers that prevent pillows and fabric bedcovering material from contacting headboards, footboards, bed posts, other bed structures, or even room walls, that bed bugs and similar crawling pests might climb to gain access to persons, animals and objects resting atop the bed.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
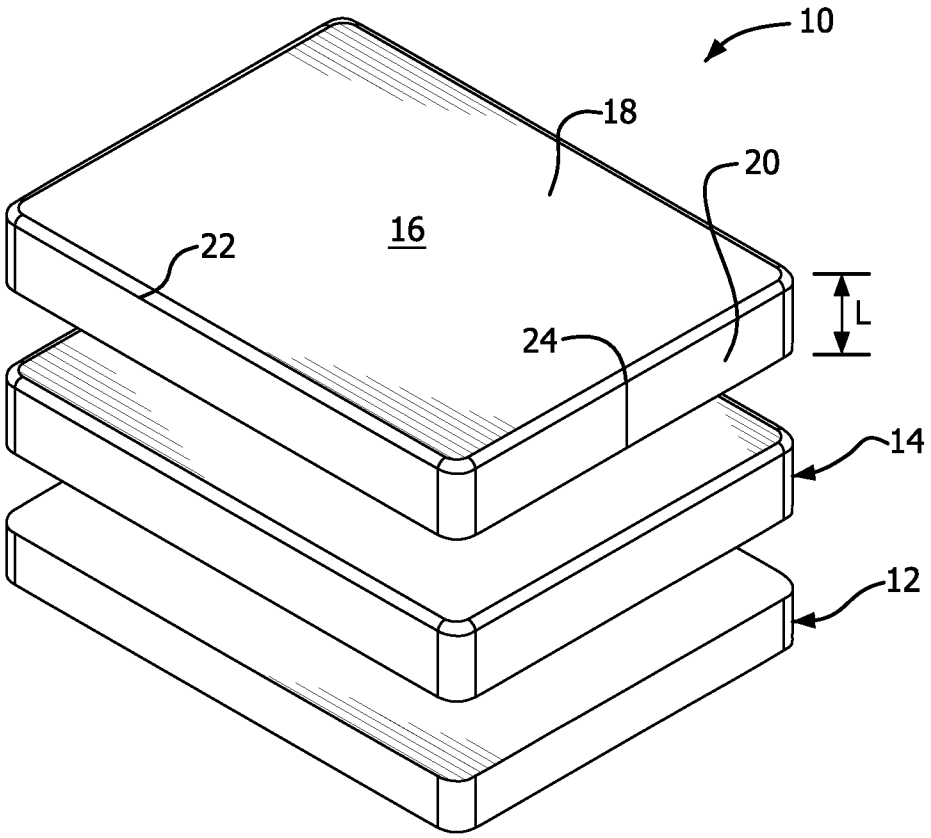
FIG. 1 is an exploded perspective view of a bedding arrangement including a box spring, a mattress and a bed bug protection device according to the present invention.
Figure 2:
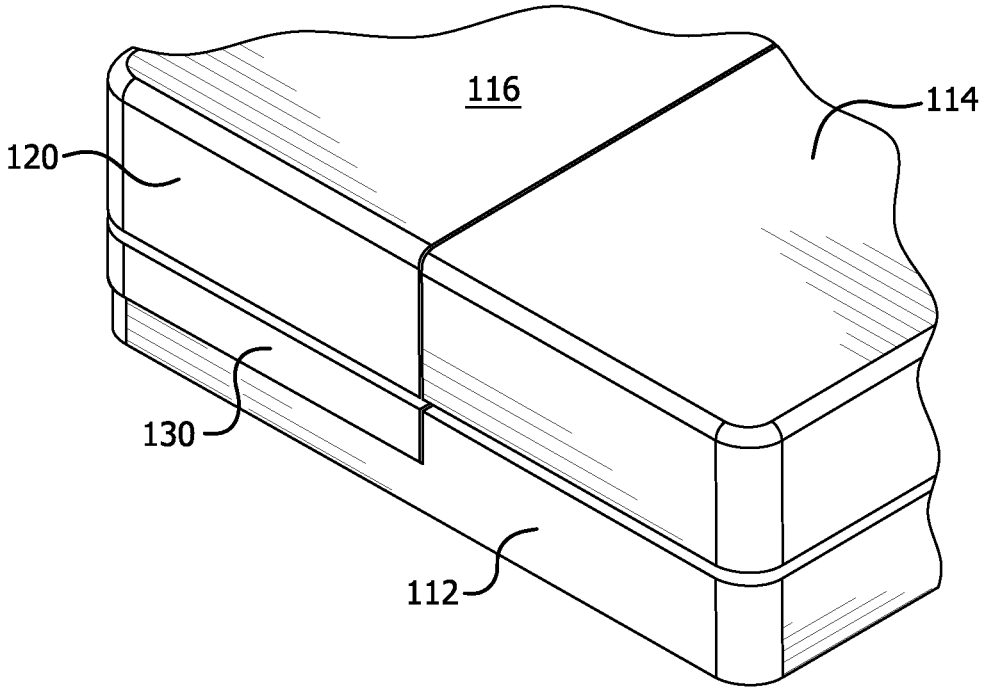
FIG. 2 is a partially cut perspective view of a first embodiment of a bed bug protection device according to the present invention tucked between a mattress and a box spring.
Figure 3:
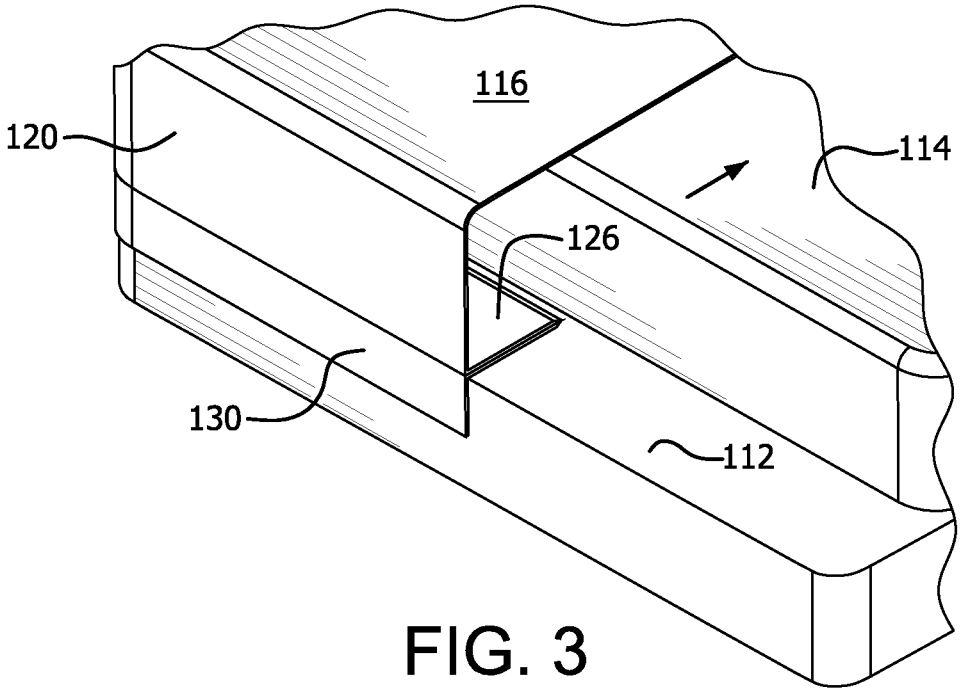
FIG. 3 is a view similar to FIG. 2 with the mattress displaced to more clearly reveal the tucked skirt of the bed bug protection device.
Figure 4:
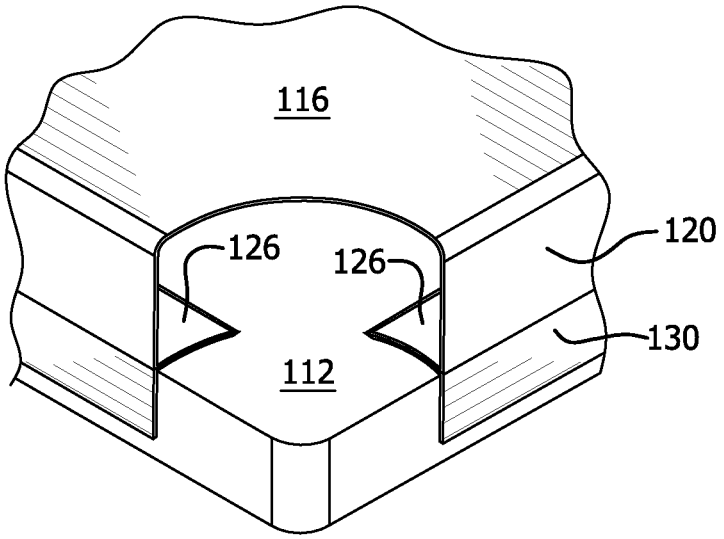
FIG. 4 is a perspective view of a corner of a bed with the mattress omitted to more clearly reveal the tucked skirt of the bed bug protection device.
Figure 5:
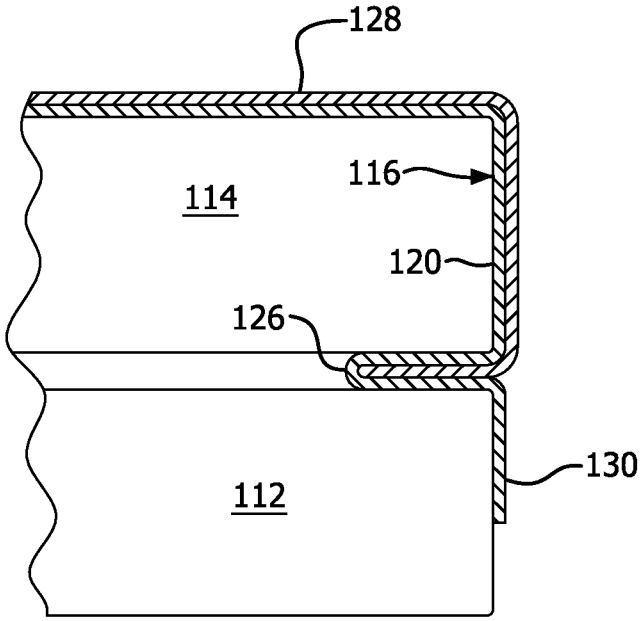
FIG. 5 an elevational cross-section view of a bed over which is placed a bed bug protection device according to the present invention, and over which device is placed a conventional bed covering.

The following definitions and discussion of general principles are offered to provide context for the subsequent detailed description of preferred embodiments of the invention.

As used herein, "smooth surfaces" or words of similar effect shall mean slippery, low friction surfaces. It is known that bed bugs and similar (typically arthropod) pests can walk across the smoothest of surfaces, including glass, when placed substantially horizontally. However, the steeper the slope or incline of a surface, the greater the difficulty bed bugs experience in climbing upwardly along the surface. Depending on the life stage of the bed bug and the smoothness of the surface, increasing the angle of incline will eventually make it impossible for the bed bugs to traverse the surface to its top. When disposed vertically or substantially vertically, bed bugs cannot traverse upwardly along smooth surfaces. Further, regardless of orientation, bed bugs and similar pests cannot cling to such surfaces. Therefore, they cannot harborage on them for prolonged periods of time and, as a result, cannot lay eggs on them that have a viable likelihood of survivability.

As used herein, "barrier" or words of similar effect shall mean material through or over which a bed bug cannot pass. Since, as noted above, it is nearly impossible to chemically or thermally treat all harborages inside a box spring, mattress or bed frame, it is important to establish a physical barrier that bed bugs cannot penetrate or traverse whereby humans, pets and other objects are isolated from the bed on which they rest.

As used herein, "outer surface" or words of similar effect shall mean a surface of the inventive device facing away from a potentially infested object, e.g., mattress and/or box spring, that is covered by the device. Conversely, an "inner surface" or words of similar effect shall mean a surface of the device facing toward the potentially infested object. The outer surface of the skirt of the subsequently described device should be substantially smooth. It is also preferable that the inner surface of the device also be smooth in order to reduce harborage and egg attachment and hinder bed bugs from moving over the interior of the device.

As used herein, "top component", "top material" or words of similar effect shall mean material that contacts the upper surface of a bed and upon which humans, pets, luggage, or other objects to be protected may rest. Such top component or top material is preferably fabricated from at least one layer of material that renders the cover impenetrable to the mouthparts of bed bugs.

As used herein, "skirt" or words of similar effect shall mean material connected to and downwardly depending from the top material.

As used herein, "fitted cover" or words of similar effect shall mean a flexible bed cover that is of a size and shape to closely conform to bed structure received therein.

As used herein, material that may be "tucked" or words of similar effect shall mean material of sufficient suppleness or pliancy to be inserted between a mattress and underlying structure, including but not limited to bed structure such as a box spring, and maintained between the bottom surface of the mattress and the underlying structure by virtue of the weight of the mattress.

With the foregoing in mind, referring to the drawings wherein like or similar references indicate like or similar elements throughout the several views, there is shown in FIG. 1 a bedding arrangement, identified generally by reference numeral 10, including a box spring 12, a mattress 14 and a fitted bed bug protection device 16 according to the present invention. Although the mattress and box spring are depicted as being of conventional rectangular shape, it will be understood that that such bedding, and the corresponding bed bug protection device of the instant invention adapted for covering same, may assume any peripheral shape.

Bed bug protection device 16 is preferably fabricated from supple materials that enable compact folding of the device for convenient storage and transport. In addition, device 16 has an open bottom whereby it may be placed over bedding without having to completely lift the bedding in order to install and remove the device. Further, the device is fitted so as to closely accommodate and conform to the underlying bedding component(s) in order to provide substantially vertical surfaces that resist climbing by crawling pests such a bed bugs and present an aesthetically pleasing profile for conventional bed coverings that may be placed atop the device.

Bed bug protection device 16 includes a top component 18 comprising barrier material suitable for preventing passage of the needle-like mouthparts of bed bugs whereby bed bugs cannot penetrate the material and bite humans or animals resting on the bedding. The barrier material may comprise either a porous material including at least one layer having pores smaller than the needle-like mouthparts of bed bugs or an essentially non-porous material alone or in combination with an overlying porous material for contacting a user's skin. In either case, multiple layers of material may be joined by any suitable lamination, bonding or other suitable fastening techniques known in the art.

Device 16 further includes a fitted, downwardly depending and continuous skirt 20 joined to the periphery of the top component 18. Skirt 20 has a slippery, i.e., low friction, exterior surface that hinders bed bugs and similar pests from climbing up the covered bedding and gaining access to humans, animals, or objects resting atop the bedding. Top component 18 and skirt 20 may be formed as a unitary construction or as separate pieces connected by mechanical or other fastening techniques. For example, the periphery of top component 18 may be joined to skirt 20 by a continuously sewn seam 22 and the ends of the skirt may be joined by a similar, sewn seam 24. If sewn together, however, it is preferable that, particularly with respect to the seam 24, the excess fabric required for producing the seams be directed toward the inner surface and not the outer substantially smooth surface of the skirt. In that way, contiguous edges of the skirt, if properly stitched, can prevent bed bugs from climbing upward along the outer surface of skirt 20. In the alternative, the ends of skirt 20 may be effectively joined by adhesive, thermal or other known bonding techniques in order to produce an essentially smooth seam that renders scaling of the skirt prohibitive to bed bugs and other such pests.

Additionally, as will be discussed in greater detail herebelow, skirt 20 is preferably of a length "L" greater than the height of the sidewalls of mattress 14 in order to minimize the likelihood of bed bugs or similar pests from scaling conventional bed coverings that may be placed atop device 16.

Turning to FIGS. 2-5, there is shown a first embodiment of a bed bug protection device according the present invention, such device identified generally by reference numeral 116. The skirt 120 of device 116 is adapted to cover the sidewalls of a mattress 114 and, at least in part, the sidewalls of a box spring 112. As seen in those figures, the length of skirt 120 is substantially greater than the height of the sidewalls of mattress 114. In particular, the length of skirt 120 is preferably at least about twice and up to about three times the height of the sidewalls of the mattress 114. So constructed, a portion of the skirt material may be inserted or tucked between mattress 114 and box spring 112 to create a tuck 126 that is effectively maintained by the weight of the mattress, the tuck being of sufficient depth to function as means for retaining conventional bed covering(s) 128 (FIG. 5), such as a fitted fabric sheet, an unfitted fabric sheet, a blanket/comforter, or any combination thereof. Together, tuck 126 and the remaining downwardly depending portion 130 of skirt 120 effectively establish a continuous barrier preventing access of bed bugs and similar pests from the box spring 112 and mattress 114 to bed covering(s) 128. Barred access to the bed covering(s) 128, the pests cannot climb the bed covering(s) and infest the top surface of the bed.

Figure 6:
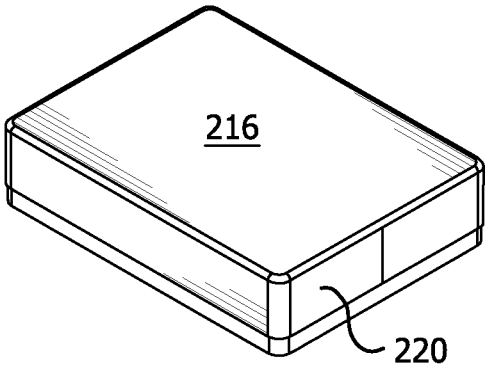
FIG. 6 is a perspective view of a further embodiment of a bed bug protection device according to the invention placed over a bed.
Figure 7:
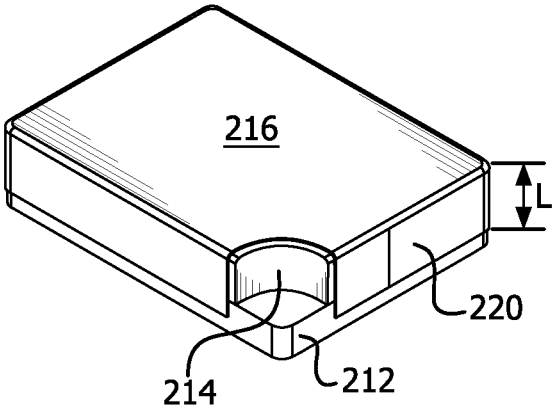
FIG. 7 is a view similar to FIG. 6 with a portion of the device and the underlying bedding cut away to better reveal the covering characteristics of the device.

Referring to FIGS. 6 and 7, there is shown a further embodiment of the invention wherein the bed bug protection device is identified by reference numeral 216. As revealed in those figures, skirt 220 has a length L which is sufficient to cover both the sidewalls of mattress 214 and at least the upper regions of the sidewalls of box spring 212. While effective for preventing bed bugs or similar pests from scaling the skirt 220 if the skirt extends below the lower edge of conventional bed covering(s) that may be placed thereover, device 216 is not equipped with dedicated means for assuring that such bed coverings do not contact either the mattress 214 or the box spring 212.

Figure 8:
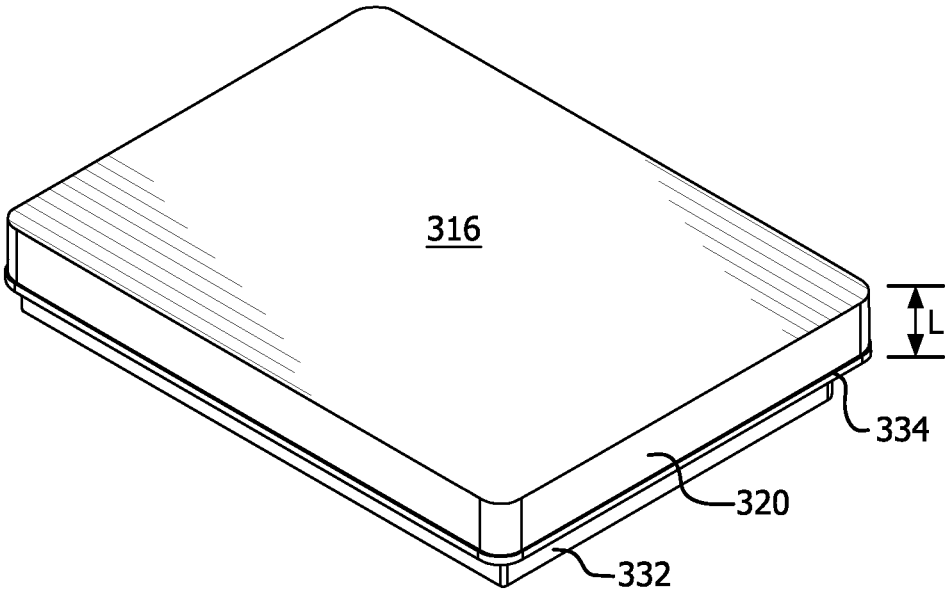
FIG. 8 is a perspective view of a further embodiment of a bed bug protection device according to the invention placed over a bed.

FIG. 8 illustrates another embodiment of a bed bug protection device according to the invention, identified generally by reference numeral 316. According to this embodiment, the length L of skirt 320 is sufficient to envelop both a mattress and a box spring, both of which are obscured by skirt 320. For context, FIG. 8 also shows a pedestal or other box spring support structure 332 beneath the box spring to convey how the skirt extends to the bottom of the box spring. Optionally the lower edge of skirt 320 may be provided with elastic, a draw string or similar means 332 for securing the skirt against the bottom of the box spring.

Figure 9:
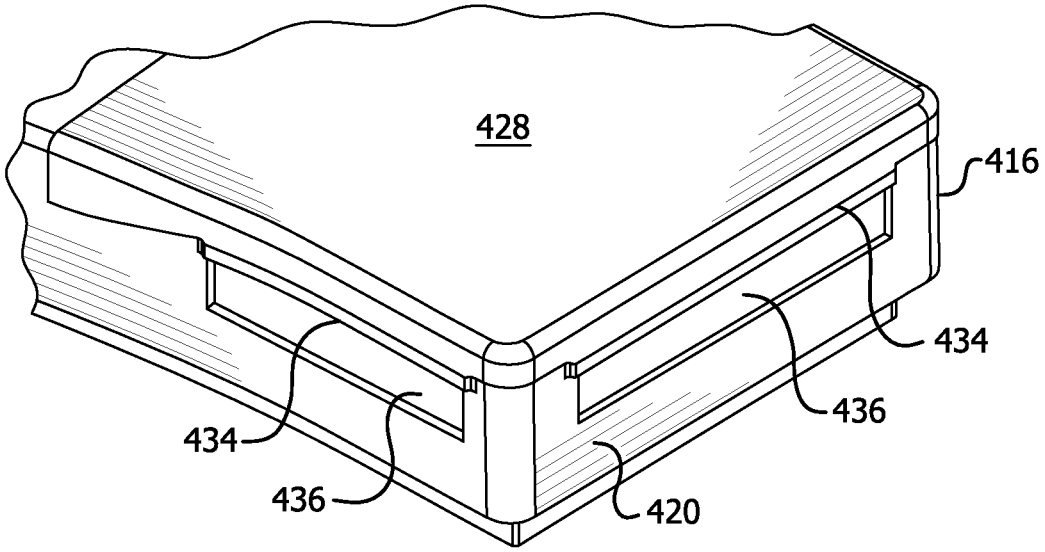
FIG. 9 is a perspective view of a further embodiment of a bed bug protection device according to the invention placed over a bed.

FIG. 9 illustrates another embodiment of a bed bug protection device according to the invention, identified generally by reference numeral 416. Unlike prior embodiments, device 416 includes means 434 external of skirt 420 for effectively preventing contact of conventional bed covering(s) 428 with underlying bedding. As illustrated, such means are constructed as one or more bands or straps 434 sewn, adhered or otherwise fixedly secured to one or more of the foot and side regions of the outer surface of skirt 420. The bottom portions 436 of the conventional bed covering(s) are inserted in means 434 in order to suspend the bed covering(s) above the lower edge of skirt 420. It will be appreciated that such means are not necessary at the head region of the skirt since a user desirous of laying on the bedding needs to lift the bed covering(s) at the head of the bed in order to lie under the bed covering(s) after which the user's body maintains the bed covering(s) separate from the bed bug protection device, at least at the head region of the bed.

Although shown as individual straps or bands, means 434 may be a continuous band spanning the bottom and side regions of skirt 420. And, in the alternative, means 434 may be constructed as closed-bottom pouches or pockets.

Figure 10:
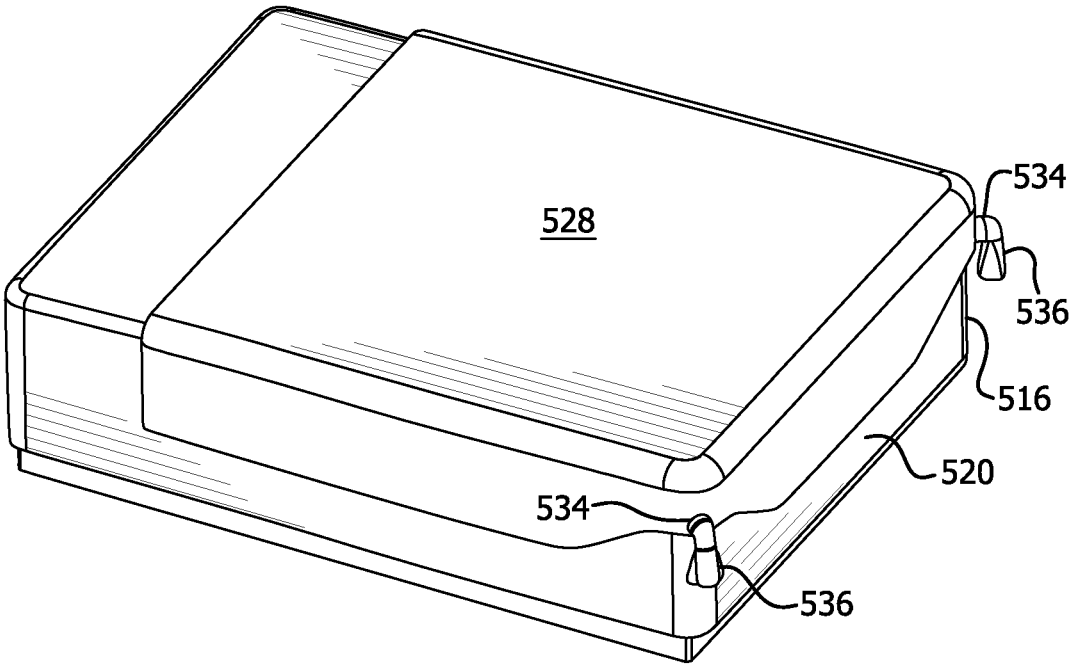
FIG. 10 is a perspective view of a further embodiment of a bed bug protection device according to the invention placed over a bed.

FIG. 10 illustrates another embodiment of a bed bug protection device according to the invention, identified generally by reference numeral 516. Similar to FIG. 9, device 516 includes means 534 exterior of skirt 520 for suspending the lower edges of bed covering(s) 528 from contacting underlying bedding. According to FIG. 10, such means 534 comprise loops or rings affixed to the corners of the skirt located at the foot of the bed through which bunched bed covering material 536 is inserted.

Figure 11:
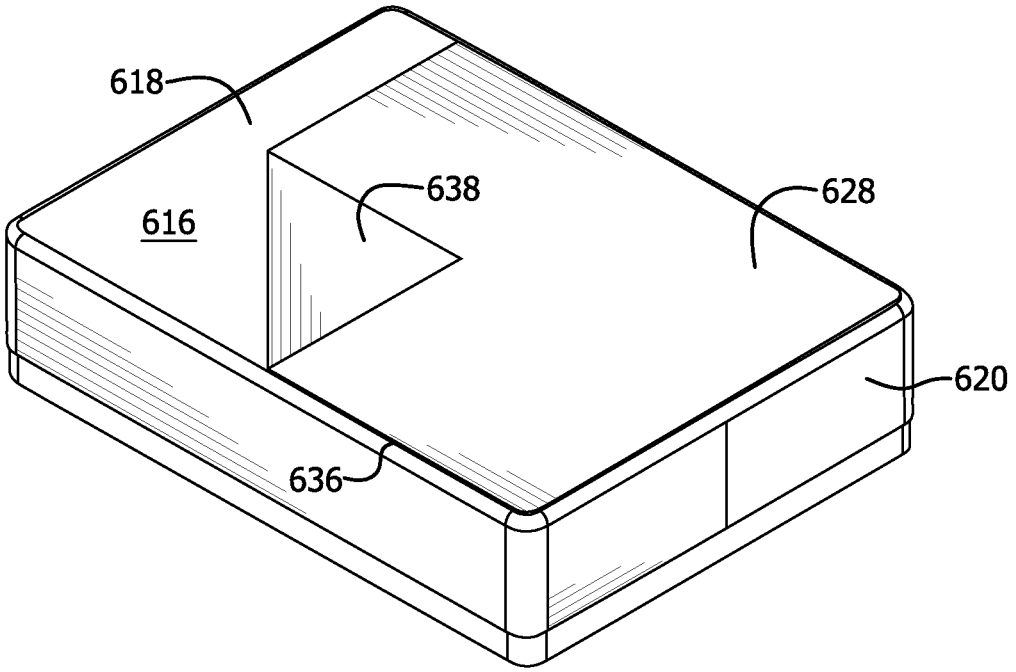
FIG. 11 is a perspective view of a further embodiment of a bed bug protection device according to the invention placed over a bed.

FIG. 11 illustrates another embodiment of a bed bug protection device according to the invention, identified generally by reference numeral 616. The construction shown in FIG. 11 departs from those illustrated in FIGS. 9 and 10 in that, rather than removable bed covering(s), such covering(s) 628 are attached to the bed covering device substantially at or near the periphery of the top component 618 along upper edge 636 via stitching, adhesives or other suitable means, thereby rendering the slippery outer surface of skirt 620 exposed. It is also contemplated that the bed covering(s) may be removably attached to the device 616 by hook and loop type fasteners, snaps, buttons or other suitable means. Preferably, bed covering(s) 628 are secured only about the lower or "foot" half of the top component 618 whereby a user may lift unattached upper or "head" portions of the bed covering(s), as shown by turned-down flap 638, to enable easy access between the top component 618 and the bed covering(s).

Figure 12:
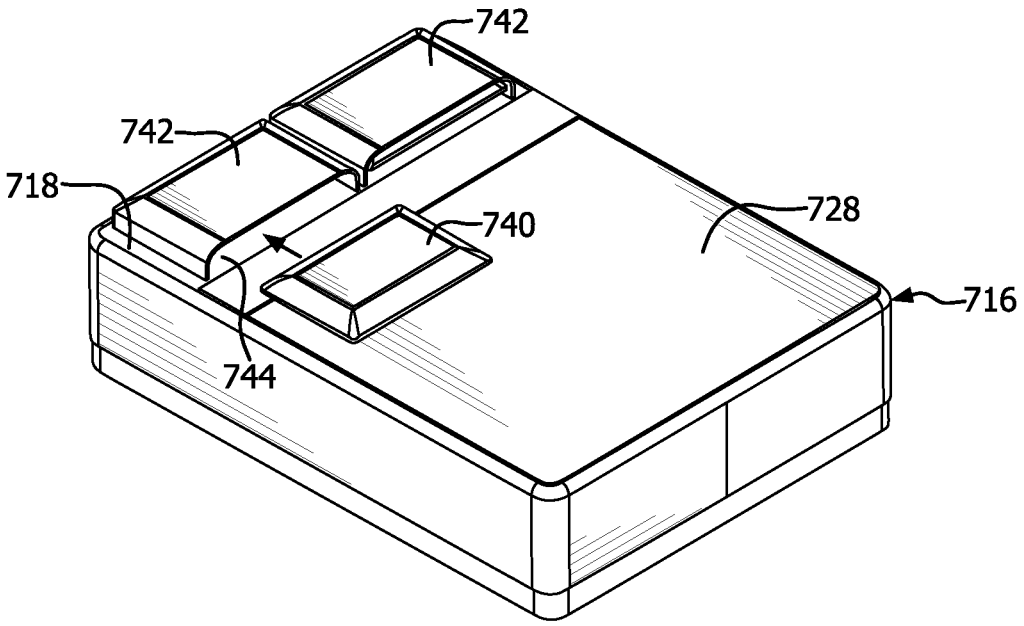
FIG. 12 is a perspective view of a further embodiment of a bed bug protection device according to the invention placed over a bed.

FIG. 12 illustrates another embodiment of a bed bug protection device according to the invention, identified generally by reference numeral 716, over which lies bed covering(s) 728 and at least one pillow 740. According to this embodiment, device 716 further includes at least one pocket 742 for preventing pillow(s) 740 from contacting an adjacent headboard or wall, not shown, which may be infested with bed bugs or like pests. Pocket 740 has an opening 744 facing in a direction toward the foot region of the top component 718 and of sufficient size to receive pillow 740. Pocket(s) 742 may be fixedly or releasably attached to the top component 718 by any suitable attachment means described above. Additionally, pocket(s) 742 may be fabricated from any supple material, including, without limitation, any conventional bed covering fabrics, e.g., linen, or any of the above-described materials used to form the top component of the bed bug protection devices according to the invention. If, however, pocket(s) 742 are made of conventional bedding fabric then it is essential the that the rear of the pocket(s) be spaced sufficiently inwardly of the peripheral edge at the head region of the top component so that the pocket(s) cannot contact the adjacent headboard or wall and possibly create a pathway for bed bugs or similar pests.

Figure 13:
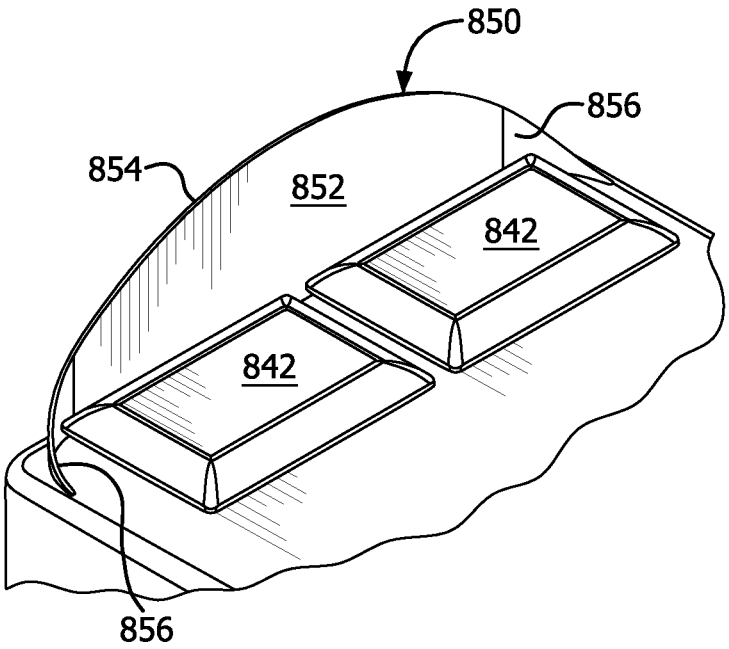
FIG. 13 is a perspective view of a collapsible divider according to the invention for preventing contact between bedding and a headboard or wall located at the head of a bed.

FIG. 13 reveals a further feature of the present invention which has utility independent of the bed bug protection devices described herein. However, it is contemplated such feature may be part of a system including any of the above-described bed bug protection devices which provides an additional measure of protection against encroachment by pests such as bed bugs.

More particularly, FIG. 13 depicts an upright device for protecting the head region of a bed from encroachment by crawling pests such as bed bugs. Such device, identified generally by reference numeral 850, is a collapsible barrier including a continuous web 852 of supple material. Preferably, at least the surface of web 852 facing toward a headboard or wall, not illustrated, is slippery, i.e., has a low coefficient of friction, to inhibit scaling by bed bugs or the like. The material of web 852 may be the same as or the functional equivalent of the materials used for the skirts of the above-described bed bug protection devices.

Device 850 further includes a collapsible frame 854 to which web 852 is attached by any suitable means. Frame 854 is made of foldable, resilient material, such as spring wire or the like, having an unstressed operative state in which the frame is unfolded. So constructed, in its operative state, the frame 854 draws the web 852 taut to establish a barrier for preventing encroachment by bed bugs and the like. Preferably, the lateral regions 856 of frame 854 are curved in the direction facing opposite an adjacent wall or headboard, i.e., toward pillow(s) 842, in order to further ensure that the pillow(s) do not contact the adjacent bedboard or wall. Significantly, device 850 is easily foldable into a compact, collapsed state whereby it may be readily packaged and transported with any of the above-described bed bug protection devices. To promote foldability of the frame 854 and reduce potential damage to the web 852 that might be caused by angular corners or edges, it preferred that at least a substantial portion, if not all, of the upper portions of frame 854 be curved. In addition, device 850 may be fixedly or releasably attached to the aforementioned bed bug protection devices by any suitable attachment means described above. It will be understood that device 850 may also be situated at the foot region of a bed, if desired.

Figure 14:
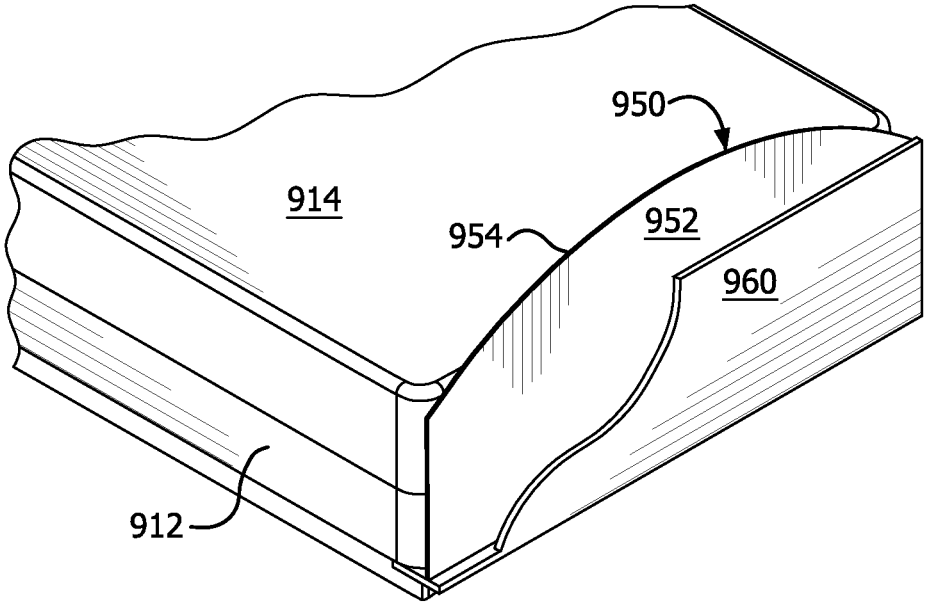
FIG. 14 is a perspective view of a collapsible divider according to the invention for preventing contact between bedding and a footboard.

FIG. 14 reveals a further feature of the present invention which has utility independent of the bed covering devices described herein. However, it is contemplated such feature may be part of a system including any of the above-described bed bug protection devices which provides an additional measure of protection against encroachment by pests such as bed bugs.

More particularly, FIG. 14 depicts an upright device for protecting the foot region of a bed from encroachment by crawling pests such as bed bugs. Such device, identified generally by reference numeral 950, is in many respects substantially similar in construction to device 850. That is, it is a collapsible barrier including a continuous web 952 of supple material. Preferably, at least the surface of web 952 facing toward a footboard 960, is slippery, i.e., has a low coefficient of friction, to inhibit scaling by bed bugs or the like. The material of web 952 may be the same as or the functional equivalent of the materials used for the skirts of the above-described bed covering devices.

Device 950 further includes a collapsible frame 954 to which web 952 is attached by any suitable means. Frame 954 is made of foldable, resilient material, such as spring wire or the like, having an unstressed operative state in which the frame is unfolded. So constructed, in its operative state, the frame 954 draws the web 952 taut to establish a barrier for preventing encroachment by bed bugs and the like. Significantly, device 950 is easily foldable into a compact, collapsed state whereby it may be readily packaged and transported with any of the above-described bed covering devices and/or barrier device 850. Device 950 is preferably simply inserted between the footboard 960 and the mattress 914 and box spring 912. In the alternative, device 950 may be fixedly or releasably attached to the aforementioned bed covering devices by any suitable attachment means described above. It will be understood that device 850 may also be situated at the head region of a bed, if desired.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A bedding arrangement comprising a bed covering device adapted to cover a mattress having a top surface and a side wall appended to a perimeter edge of the top surface and arranged to extend downwardly away from the top surface, the bed covering device including a top component adapted to contact and cover the top surface of a mattress covered by the bed covering device and a skirt adapted to surround a side wall of a mattress and configured to include an interior surface facing inwardly toward the side wall of a mattress covered by the bed covering device and an exterior surface facing outwardly away from the side wall of a mattress covered by the bed covering device, wherein the exterior surface of the skirt is a substantially slippery, low friction surface sufficient to block upward traversal of bed bugs along the exterior surface to reach the top component upon placement of the exterior surface in a substantially vertical orientation alongside the side wall of a mattress covered by the bed covering device;

a mattress covered by the bed covering device;

a box spring underlying and supporting the mattress along an interface defined therebetween, and the skirt of the bed covering device is tucked to extend into the interface provided between a bottom of the mattress and a top of the box spring and arranged to drape at least partially over the side wall of the box spring and form an outwardly opening sheet receiver located between the mattress and the box spring; and a bedding sheet covering the mattress with all ends terminating within the outwardly opening sheet receiver.

2. The bedding arrangement of claim 1, wherein the top component and skirt cooperate to form a unitary member made of a barrier material configured to prevent passage of needle-like mouthparts of bed begs therethrough so that bed bugs cannot penetrate the top component and the skirt.

3. The bedding arrangement of claim 1, wherein the top component is made of a barrier material configured to prevent passage of needle-like mouthparts of bed bugs therethrough so that bed bugs cannot penetrate the top component.

4. The bedding arrangement of claim 3, wherein a periphery of the top component is bonded to the skirt to produce a smooth seam between the top component and the skirt that renders scaling of the skirt to reach the top component prohibitive to bed bugs.

5. The bedding arrangement of claim 3, wherein the barrier material comprises a porous material including at least one layer having pores smaller than the needle-like mouthparts of bed bugs.

6. The bedding arrangement of claim 3, wherein the barrier material comprises a non-porous material.

7. The bedding arrangement of claim 6, wherein the barrier material further comprises a porous material arranged to overlie the non-porous material.

8. The bedding arrangement of claim 3, wherein a periphery of the top component is joined to the skirt by a continuously sewn seam.

9. The bedding arrangement of claim 8, wherein any excess barrier material included in the top component and used to produce the seam is directed toward the inner surface of the skirt.

10. The bedding arrangement of claim 1, wherein the skirt includes, in series, an endless upper portion appended to the top component and placed in a vertical orientation alongside a side wall of the mattress, an endless upper tuck layer coupled to the endless upper portion along a first fold line and arranged to lie between the mattress and the box spring, an endless lower tuck layer coupled to the endless upper tuck layer along a second fold line and arranged to lie between the upper tuck layer and the box spring, and an endless downwardly depending portion coupled to the endless lower tuck layer along a third fold line and placed in a vertical orientation alongside a side wall of the box spring, and exterior surfaces of the endless upper and lower tuck layers cooperate to form the outwardly opening sheet receiver lying between the mattress and the box spring for receiving and retaining a peripheral portion of the bedding sheet placed on the top component of the bed covering device to establish a continuous barrier along the peripheral portion of the bedding sheet preventing access of bed bugs extant on at least one of the mattress and the box spring to the bedding sheet.

11. The bedding arrangement of claim 10, wherein the skirt includes a top edge appended to the top component and a bottom edge arranged to lie in spaced-apart relation to the top edge when the bed covering device is arranged to cover the mattress, the skirt has a length that is equal to a shortest distance between the top and bottom edges when the skirt is arranged to hang downwardly from the top component without being tucked into a space provided between the mattress and the box spring, and the length of the skirt is at least about twice the height of the side wall of the mattress.

12. The bedding arrangement of claim 1, wherein a horizontal length of the endless upper tuck is about equal to a horizontal length of the endless lower tuck.

13. The bedding arrangement of claim 1, wherein the skirt is arranged to envelop the mattress and the box spring.

14. The bedding arrangement of claim 13, further comprising elastic or a draw string coupled to the skirt for securing the skirt against a bottom of the box spring.

15. The bedding arrangement of claim 1, wherein the skirt includes a top edge appended to the top component and a bottom edge arranged to lie below and in spaced-apart relation to the top edge when the bed covering device is placed on the mattress to cover the mattress and the bed covering device further includes sheet-suspension means external of the skirt for suspending the bedding sheet placed on the top component above the bottom edge of the skirt to locate lower edges of the bedding sheet away from the skirt.

16. The bedding arrangement of claim 15, wherein the sheet-suspension means includes a strap fixed to the exterior surface of the skirt and arranged to lie between the top and bottom edges of the skirt.

17. The bedding arrangement of claim 15, wherein the sheet-suspension means includes a ring affixed to a corner of the skirt through which a bunched sheet is inserted.

18. The bedding arrangement of claim 1, further comprising a pillow-receiver coupled to the top component for receiving a pillow to block such pillow from contacting an adjacent headboard or wall.

19. A bedding arrangement comprising bedding having a top surface and a side wall appended to a perimeter edge of the top surface and arranged to extend downwardly away from the top surface;

a bed covering device including a top component contacting and covering the top surface of the bedding and a skirt surrounding the side wall of the bedding and configured to include an interior surface facing inwardly toward the side wall of the bedding and an exterior surface facing outwardly away from the side wall of the bedding, wherein the exterior surface of the skirt is a substantially slippery, low friction surface sufficient to block upward traversal of bed bugs along the exterior surface to reach the top component upon placement of the exterior surface in a substantially vertical orientation alongside the side wall of the bedding, wherein the top component is made of a barrier material configured to prevent the passage of needle-like mouthparts of bed bugs therethrough so that bed bugs cannot penetrate the top component;

a mattress covered by the bed covering device;

a box spring underlying and supporting the mattress along an interface defined therebetween, wherein the skirt of the bed covering device is tucked to extend into the interface provided between a bottom of the mattress and a top of the box spring and arranged to drape at least partially over the side wall of the box spring and form an outwardly opening sheet receiver located between the mattress and the box spring; and a bedding sheet covering the mattress with ends terminating within the outwardly opening sheet receiver.

20. A bedding arrangement comprising:

a mattress;

a box spring underlying and supporting the mattress and defining an external interface therebetween;

a bed covering device having a slippery, low friction external surface sufficient to block traversal of bed bugs upon the external surface when vertically oriented, wherein the bed covering device covers the mattress and depends downwardly away from a top surface of the mattress, and wherein a portion of the bed covering device forms an outwardly opening sheet receiver along the entire external interface having a top portion adjacent a bottom surface of the mattress, a bottom portion adjacent a top surface of the box spring and an inner portion spaced from the external interface connecting the top and bottom portions, and a portion of the bed covering device depends downwardly from the outwardly opening sheet receiver; and a bedding sheet covering the mattress and the bed covering device with ends terminating between the top portion and the bottom portion of the outwardly opening sheet receiver.

21. The bedding arrangement of claim 20, further comprising a head frame connected to the bed covering device, the head frame comprising:

a single panel head structure having a shell shape that is positioned above the top surface of the mattress and curved toward a center of the mattress; and a head web attached to the head structure and made of a material having a slippery, low friction surface sufficient to block upward traversal of bed bugs along a surface of the head web.

22. The bedding arrangement of claim 21, wherein the head structure is formed of a wire and the shell shape forms a continuous three dimensional curve.

* * * * *